US005483739A

United States Patent [19]

Smith et al.

[11] Patent Number: 5,483,739

[45] Date of Patent: Jan. 16, 1996

[54] ELECTRICAL TERMINAL APPLICATOR WITH IMPROVED CRIMP HEIGHT ADJUSTMENT PLATE MEANS

[75] Inventors: Vernon A. Smith, Naperville; Robert A. Suthard, Woodridge; Kevin J. Urness, St. Charles; Russell E. Wende, Oak Lawn, all of Ill.

[73] Assignee: Molex Incorporated, Lisle, Ill.

[21] Appl. No.: 195,616

[22] Filed: Feb. 14, 1994

[51] Int. Cl.[6] ..... H01R 43/04

[52] U.S. Cl. ..... 29/753; 72/441

[58] Field of Search ..... 29/753, 751; 72/446, 72/441

[56] References Cited

U.S. PATENT DOCUMENTS

| | | | |
|---|---|---|---|
| 4,587,725 | 5/1986 | Ogawa et al. | 29/753 |
| 4,790,173 | 12/1988 | Boutcher, Jr. | 72/446 |
| 4,970,889 | 11/1990 | Phillips et al. | 72/446 |
| 5,033,283 | 7/1991 | Gloe et al. | 72/481 |
| 5,095,599 | 3/1992 | Gloe et al. | 29/33 M |
| 5,289,713 | 3/1994 | Schafer | 72/446 |

*Primary Examiner*—Carl E. Hall

*Attorney, Agent, or Firm*—Charles S. Cohen

[57] ABSTRACT

An electrical terminal applicator includes an applicator ram drivable by a press ram through a working stroke towards, and a return stroke away from, a crimping anvil. A first crimping die is mounted on the applicator ram for cooperation with the anvil to crimp a first portion of an electrical terminal onto the insulation of an insulated electrical wire during each working stroke of the applicator ram. A second crimping die is mounted on the applicator ram for cooperation with the anvil to crimp a second portion of the terminal onto a conductive core of the electrical wire during each working stroke of the applicator ram. A first adjusting plate is mounted for rotation about an axis on and extending in the direction of movement of the applicator ram and includes a concentric ramped striking surface for engaging a striker surface operatively associated with the first crimping die, to adjust the shut height of the first die in response to rotating the first adjusting plate. A second adjusting plate is mounted for rotation about the axis and includes a concentric ramped striking surface for engaging a striker surface operatively associated with the second crimping die, to adjust the shut height of the second die independently of adjusting the shut height of the first die in response to independently rotating the second adjusting plate.

17 Claims, 4 Drawing Sheets

ELECTRICAL TERMINAL APPLICATOR WITH IMPROVED CRIMP HEIGHT ADJUSTMENT PLATE MEANS

FIELD OF THE INVENTION

This invention generally relates to the art of electrical terminal applicators and, particularly, to an improved crimp height adjustment plate means therefor.

BACKGROUND OF THE INVENTION

A known type of electrical terminal applicator includes an applicator ram drivable by a press ram through a working stroke towards, and a return stroke away from, a crimping anvil. The applicator ram has a first crimping die for cooperation with the anvil to crimp a first portion of an electrical terminal onto an exposed end of a conductive core of an insulated electrical wire during each working stroke of the applicator ram. The applicator ram has a second crimping die for cooperation with the anvil to crimp a second portion of the terminal onto the insulation of the electrical wire during each working stroke of the applicator ram. The second crimping die is adjustable axially of the applicator ram. Plate means are mounted for angular adjustment about an axis on, and extending lengthwise of, the applicator ram. The plate means selectively interpose first projections between the press ram and the applicator ram to adjust the shut height of the first and second dies, and selectively interpose second projections between the applicator ram and the second crimping die to independently adjust the shut height of the second die.

In this known terminal applicator, the plate means include two calibrated plates which are independently angularly adjustable manually about the axis of the applicator ram. One of the plates carries the projections for adjusting the shut height of both the first and second dies, and the other plate carries the projections for adjusting the shut height of the second die. Thus, for each position of adjustment of the first die there are a plurality of positions of adjustment of the second die. The plates are held in their desired angular position by detent balls that are received in recesses. An example of this type of known applicator is shown in U.S. Pat. No. 4,718,160 to Bulanda, dated Jan. 12, 1988.

An applicator is known in the prior art as having three stacked, calibrated discs or rings, each being on the order of 5 mm thick. The upper ring has upwardly directed projections to adjust both the insulation and conductor crimp heights. The lower ring has downwardly directed projections that contact the insulation crimp tooling for addition adjustment thereof independent of the conductor crimp height. The middle ring also has downwardly directed projections that contact that conductor crimp tooling for adjustment thereof independent of the insulation crimp height. The lower ring is generally annular to permit the projections of the middle ring to extend through the plane of the lower ring and contact the conductor crimp tooling. The applicator includes two strikers, an outer one for contacting the projections of the lower ring and the insulation crimp tooling and an inner one for contacting the projections of the middle ring and the conductor crimp tooling.

Another applicator is manufactured by Schaefer Werkzeug und Sondermaschinenbau G.m.b.H. which has a pair of crimp height adjustment rings. At least the bottom ring appears to be tapered in a continuous cam and contact a striker which in turn contacts crimp tooling.

The present invention is directed to improvements in the adjustment plate means which adjust the crimp heights of the two dies in an electrical terminal applicator of the character described above. Specifically, the adjustment plate means of the present invention include two adjusting plates which are continuously or gradually adjustable by employing ramped adjusting surfaces versus the finite number of positions of adjustment afforded by the calibrated plates of the prior art. Not only do the ramped adjusting plates of the invention provide for infinitely more adjusting positions, but the plates are considerably less expensive to manufacture. An adjusting plate can be cast and used practically as fabricated, whereas the projections on the calibrated plates of the prior art must be machined to precise specifications after the plates are cast.

SUMMARY OF THE INVENTION

An object, therefore, of the invention is to provide an electrical terminal applicator of the character described, with an improved crimp height adjustment plate means therefor.

In the exemplary embodiment of the invention, an electrical terminal applicator includes an applicator ram drivable by a press ram through a working stroke towards, and a return stroke away from, a crimping anvil. A first crimping die is mounted on the applicator ram for cooperation with the anvil to crimp a first portion of an electrical terminal onto the insulation of an insulated electrical wire during each working stroke of the applicator ram. A second crimping die is mounted on the applicator ram for cooperation with the anvil to crimp a second portion of the terminal onto a conductive core of the electrical wire during each working stroke of the applicator ram.

A first adjusting plate means is mounted for rotation about an axis on and extending in the direction of movement of the applicator ram and includes a concentric ramped striking surface for engaging a striker surface operatively associated with the first crimping die, to adjust the shut height of the first die in response to rotating the first adjusting plate means. A second adjusting plate means is mounted for rotation about the axis and includes a concentric ramped striking surface for engaging a striker surface operatively associated with the second crimping die, to adjust the shut height of the second die independently of adjusting the shut height of the first die in response to independently rotating the second adjusting plate means.

As disclosed herein, the concentric ramped striking surface of the first adjusting plate means is of a larger diameter than that of the concentric ramped striking surface of the second adjusting plate means. The striker surfaces are generally on a line radially of the axis of rotation of the adjusting plate means. Preferably, the striker surfaces are arcuate about the radial lines.

In the preferred embodiment of the invention, the striker surfaces are defined by striker members operatively associated with the crimping dies. Each striker member has a center line generally parallel to the axis of rotation of the adjusting plate means. The striker surfaces have very small areas on the center lines of the striker members to minimize any rotational forces being transferred from the striking surfaces of the adjusting plate means to the striker surfaces of the striker members.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims.

The invention, together with its objects and the advantages thereof, may be best understood by reference to the following description taken in conjunction with the accompanying drawings, in which like reference numerals identify like elements in the figures and in which.

DETAILED DESCRIPTION OF THE PREFERRED EMBODIMENT

Figure 1:
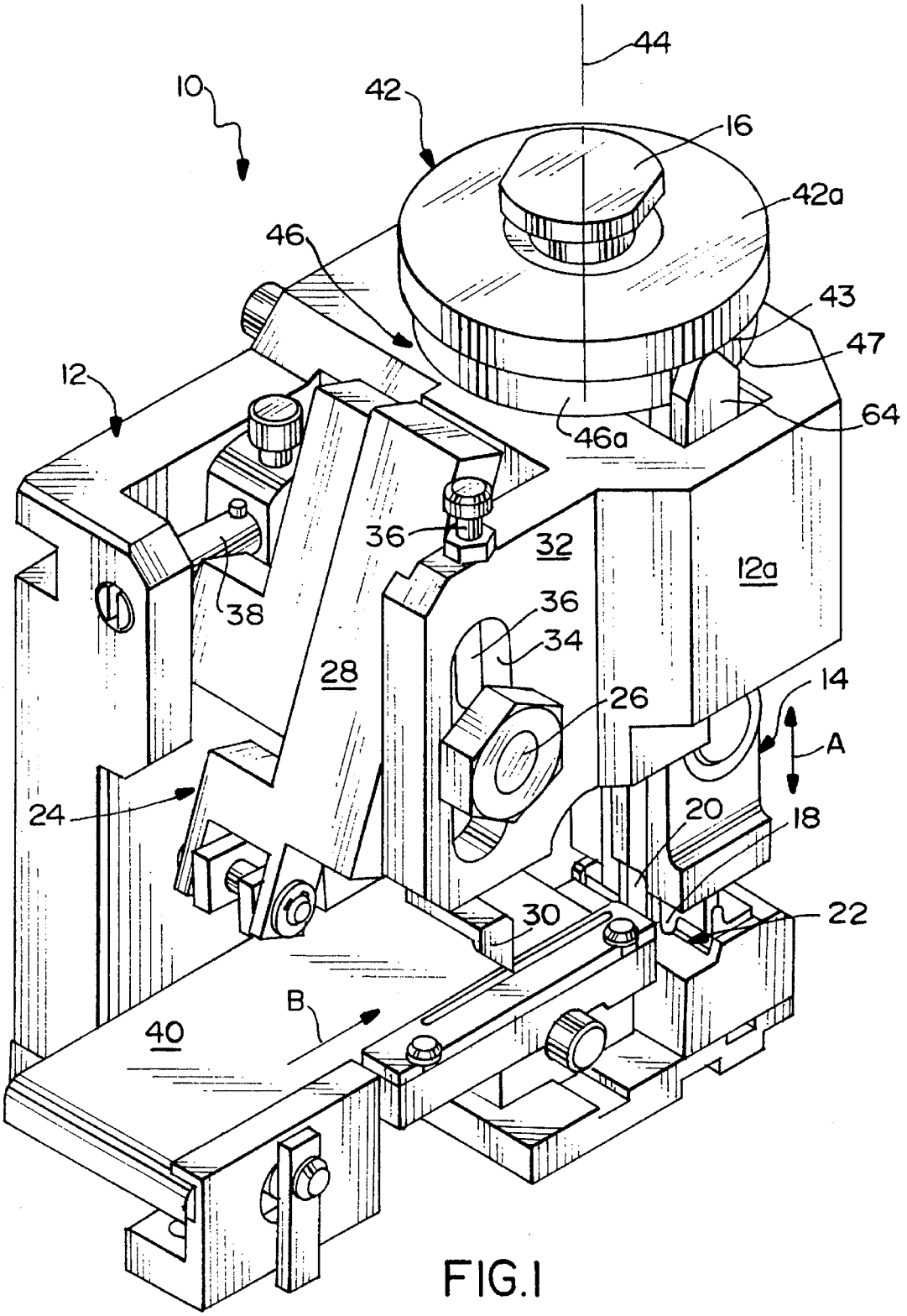
FIG. 1 is a perspective view of a portion of an applicator for crimping electrical terminals to stripped end portions of insulated electrical wires, the applicator including crimp height adjustment plate means according to the invention.

Referring to the drawings in greater detail, and first to FIG. 1, an electrical terminal applicator, generally designated 10, includes a frame, generally designated 12, which, in turn, includes an applicator ram housing 12*a* in which is mounted an applicator ram, generally designated 14, for vertical reciprocating motion within the housing in the direction of double-headed arrow "A". An adaptor head 16 projects upwardly of applicator ram 14 for engagement by a press ram 17 (FIG. 2), as described hereinafter. An insulation crimping die 18 projects from the bottom of applicator ram 14, beneath housing 12*a*, and is juxtaposed with a conductive core crimping die 20 also projecting from the applicator ram beneath housing 12*a*. Die 18 is positioned forwardly of die 20 when viewed in FIG. 1. A crimping anvil means, generally designated 22, is located on frame 12 beneath crimping dies 18 and 20.

In the general operation of applicator 10, applicator ram 14 is drivable by means of press ram 17 through a working stroke towards, and a return stroke away from, crimping anvil means 22, as indicated by double-headed arrow "A". First or rear crimping die 20 cooperates with anvil means 22 to crimp a first portion of an electrical terminal onto an exposed end of a conductive core of an insulative electrical wire during each downward working stroke of applicator ram 14. Second or front crimping die 18 cooperates with anvil means 22 to crimp a second portion of the terminal onto the insulation of the electrical wire during each downward working stroke of the applicator ram.

Still referring to FIG. 1, a terminal strip feed assembly, generally designated 24, is secured between frame 12 and housing 12*a* and includes a pivot pin 26, a rocker arm 28 and a feed finger 30 which is loaded by a return spring (not shown). The return spring is behind a brace portion 32 of housing 12*a* and is provided by a torsion coil spring about pin 26. The pivot pin is adjustable lengthwise of a slot 34 in brace 32 to determine the end positions of feed finger 30. In other words, adjustment of the location of the pivot point defined by pin 26 adjusts the length of stroke of feed finger 30. The pivot pin is adjustable by means of a screw 36. Rocker arm 28 is swung about pivot pin 26 by means of a slidable rod 38 driven by a cam (not shown) on the ram 14 that engages a cam follower (not shown) secured to rod 38 to feed a strip of terminals along a platen 40 in the direction of arrow "B" toward anvil means 22 to locate the leading terminal of the strip on the anvil. As the press ram drives applicator ram 14 downwardly as described above, crimping dies 18 and 20 are effective to crimp the lead terminal onto the stripped end of the insulated electrical wire. The press ram/applicator ram are cycled in unison with the operation of rocker arm 28 and feed finger 34 to incrementally advance terminals from the strip thereof to the crimping station defined by anvil means 22 and crimping dies 18 and 20.

Generally, a plurality of adjusting plate means are provided for adjusting the shut heights of crimping die 18 and/or crimping die 20. Specifically, a first adjusting plate, generally designated 42, is mounted for angular adjustment about an axis 44 on and extending in the direction of movement of applicator ram 14. The first adjusting plate generally is a cast circular plate 42*a* which has a bottom, concentric ramped striking surface 43 for purposes of adjusting the shut height of crimping die 18 as described hereinafter.

A second adjusting plate, generally designated 46, is mounted for angular adjustment about axis 44. The second adjusting plate includes a cast circular plate 46*a* having a bottom, concentric ramped striking surface 47 for adjusting the shut height of crimping die 20 as will be described hereinafter.

Figure 2:
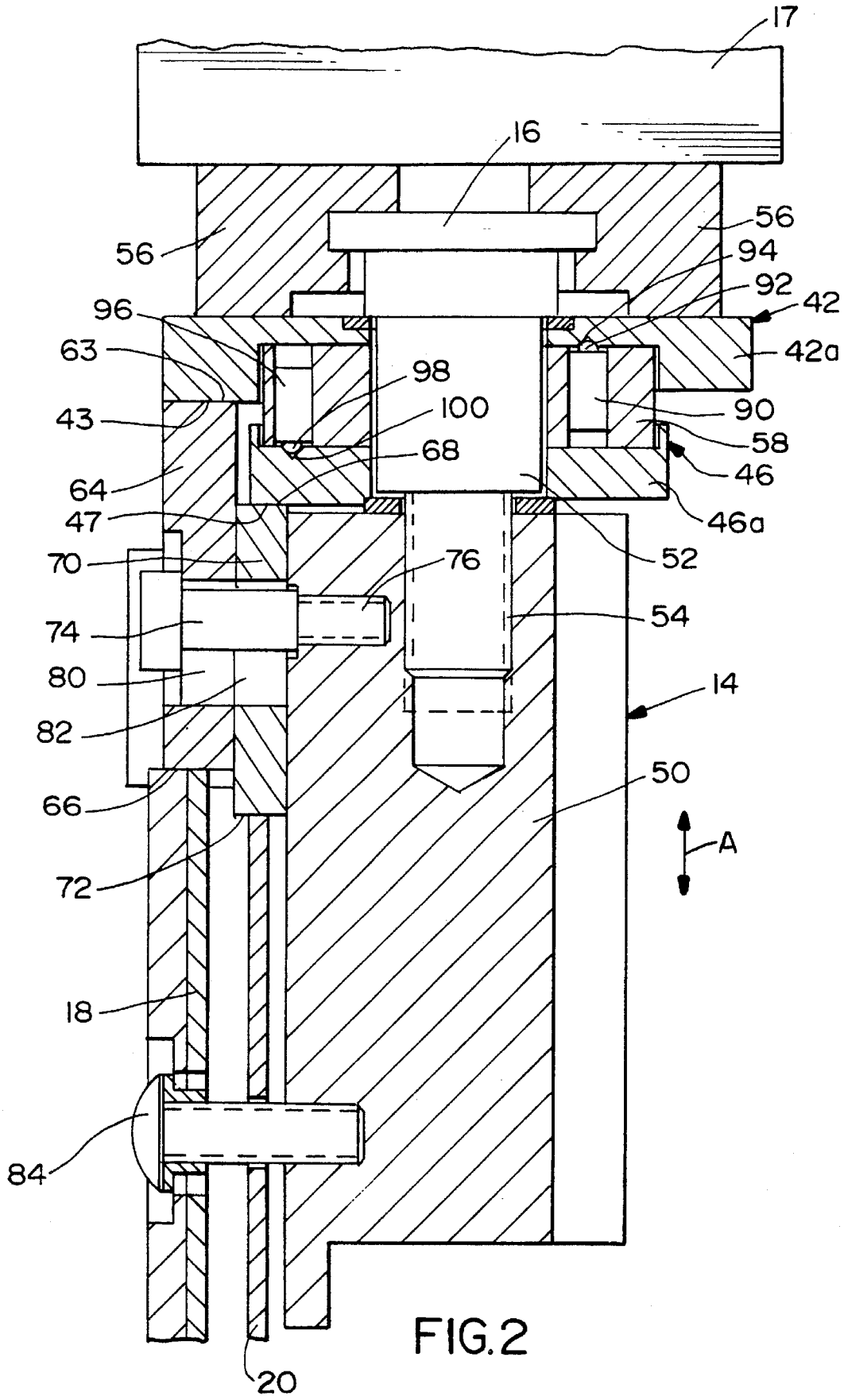
FIG. 2 is a vertical section through an applicator ram according to the invention.
Figure 3:
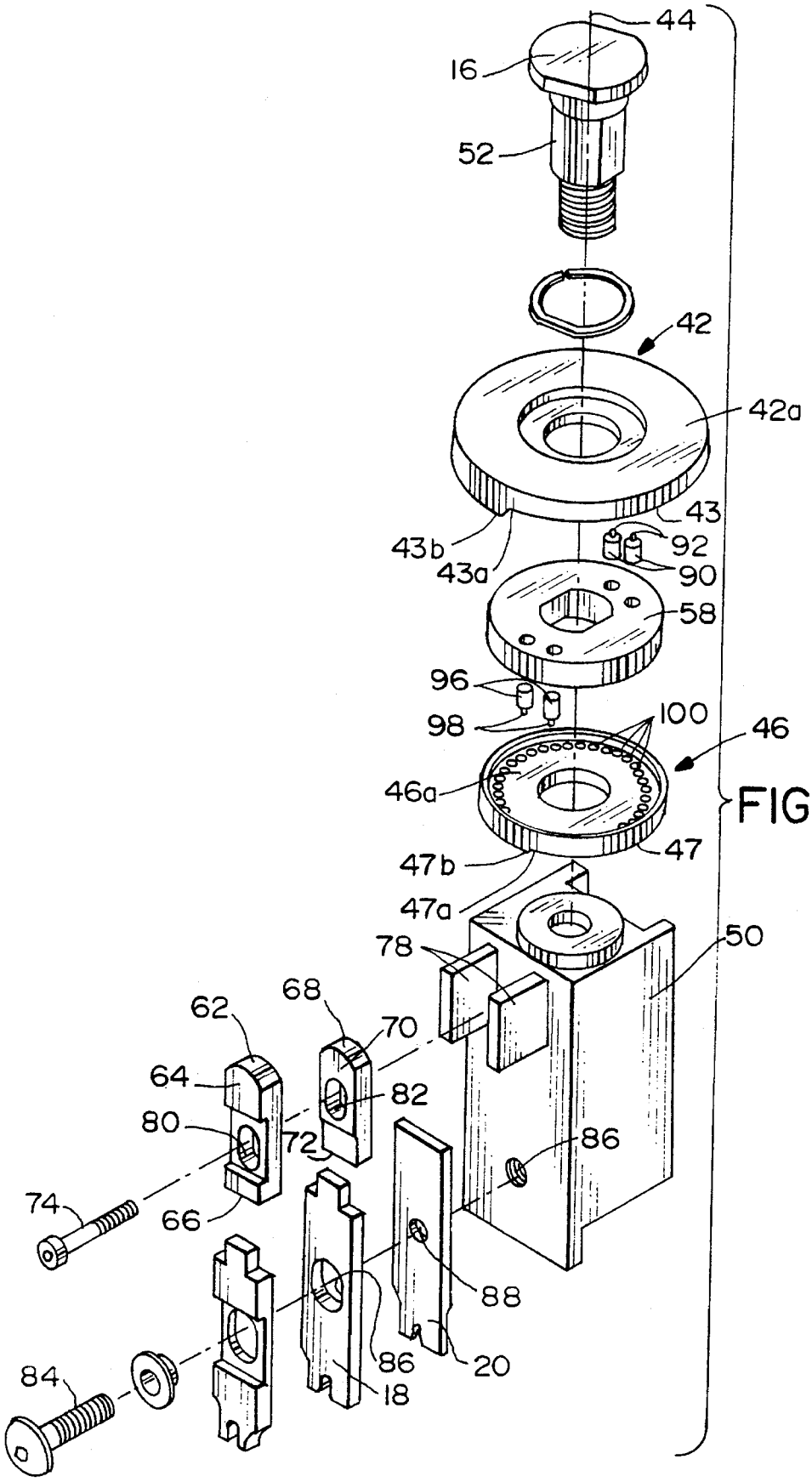
FIG. 3 is an exploded perspective view of the components of the applicator ram.

More particularly, the details of the invention are shown in FIGS. 2–7. Referring first to FIGS. 2 and 3, first and second adjusting plates 42*a* and 46*a*, respectively, are mounted to the top of a ram block 50 of applicator ram 14 by a stepped bolt 52 depending from adaptor head 16. The bolt is threaded into ram block 50, as at 54. At least a pair of opposed claws 56 depend downwardly from press ram 17 and embrace adaptor head 16 of the applicator ram. A detent plate 58 is sandwiched between first and second adjusting plates 42*a* and 46*a*, respectively.

From the foregoing, it can be understood that applicator ram 14, including adjusting plates 42*a* and 46*a*, along with detent plate 58, is vertically reciprocated by press ram 17 in the direction of double-headed arrow "A" within ram housing 12*a*. The downward stroke of the vertical reciprocating motion defines the working stroke of the applicator ram 14.

Figure 4:
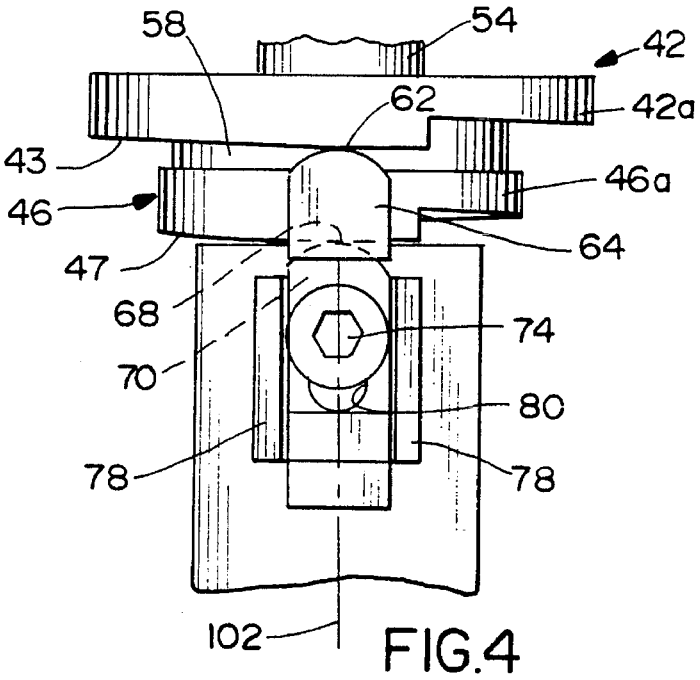
FIG. 4 is a fragmented front elevational view of the applicator ram, with the crimping dies removed.
Figure 7:
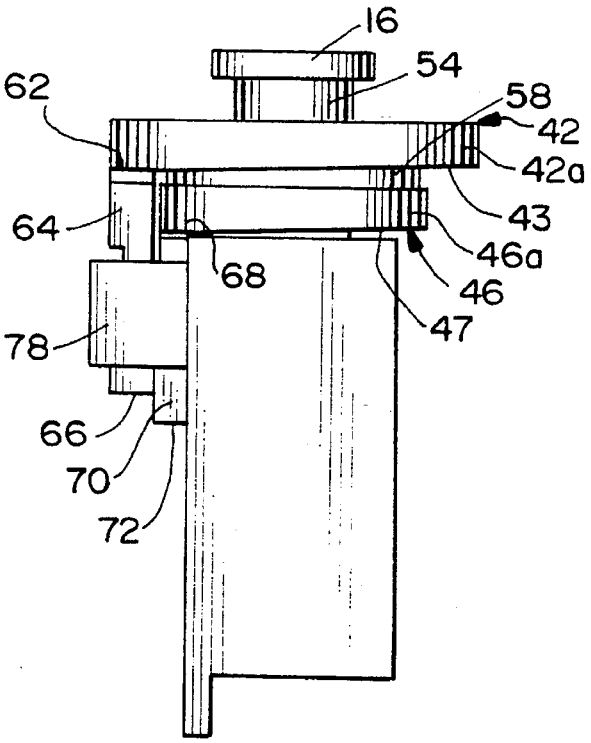
FIG. 7 is a side elevational view of the applicator ram, with the crimping dies removed.
Figure 5:
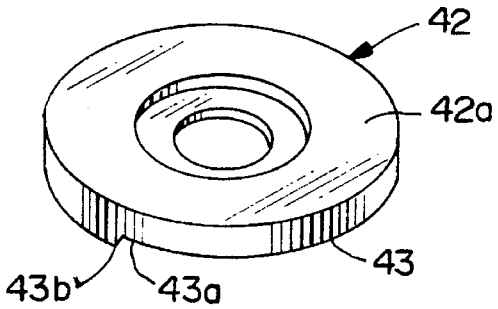
FIG. 5 is a perspective view of the first adjusting plate means.
Figure 6:
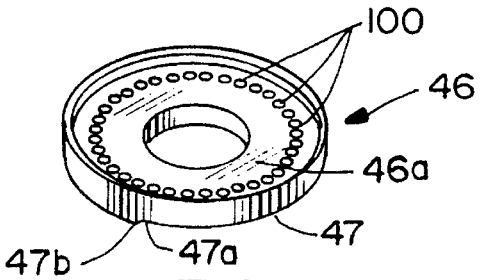
FIG. 6 is a perspective view of the second adjusting plate means.

As stated above, first adjusting plate 42*a* has a bottom, concentric ramped striking surface 43, and second adjusting plate 46*a* has a bottom, concentric ramped striking surface 47. Referring to FIGS. 4 and 6 in conjunction with FIGS. 2 and 3, striking surface 43 of first adjusting plate 42*a* engages an upper surface 62 of a striker member 64 which, in turn, has a bottom surface 66 for engaging the top of first crimping die 18. Similarly, striking surface 47 of second adjusting plate 46*a* engages an upper surface 68 of a striker member 70 which, in turn, has a bottom surface 72 for engaging the top of second crimping die 20. As seen best in FIGS. 2 and 3, striker members 64 and 70 are mounted to the front of ram block 50 by means of a bolt 74 threaded into the block, as at 76. The striker members are positioned between a pair of ears 78 (FIG. 3) projecting from the front of ram block 50. Striker member 64 has a vertically elongated hole 80, and striker member 70 has a vertically elongated hole 82 through which bolt 74 projects. In operation, the striker members are vertically movable while still being maintained on ram block 50 by bolt 74. For similar purposes, a mounting bolt 84 (FIG. 3) extends through vertically elongated holes 86 and 88 in crimping dies 18 and 20, respectively. Bolt 84 is threaded into ram block 50 at 86.

As stated above, detent plate 58 is sandwiched between first and second adjusting plates 42*a* and 46*a*, respectively. FIGS. 2 and 3 show that the detent plate mounts a pair of detent cylinders 90 having upwardly directed, spring loaded detent balls 92 which are biased into detent recesses 94 (FIG. 2) in the underside of first adjusting plate 42*a*. Similarly, a pair of detent cylinders 96 have downwardly directed, spring loaded detent balls 98 which are biased into cup-like recesses 100 in the top side of second adjusting plate 46*a*. As best seen in FIG. 3, recesses 100 (as well as recesses 94) are in a circular array about axis 44.

Second adjusting plate 46*a* has thirty six recesses 100 evenly spaced about axis 44 so that rotation of the plate from one recess to the next results in a 10° rotation of the plate. The pair of cylinders 96 with detent balls 98 are positioned 5° apart on a circle aligned with recesses 100 of plate 46*a*. Accordingly, only one detent ball will engage a recess 100 at a time. This results in seventy two distinct positions to which the plate 46*a* can be rotated. Each new position results in a change of crimp height of approximately 0.00067 inches compared to the adjacent crimp heights. Although probably not necessary due to the extremely fine adjustment provided by detent balls 98 and recesses 100, it is possible to position plate 46*a* with the detent balls between recesses 100 if desired, in order to permit even further fine adjustment. In the alternative, such recesses 100 could be eliminated and detent balls 98 modified to utilize only friction to maintain the angular position of plate 46*a*.

First adjusting plate has a similar arrangement of detent balls 92 and recesses 94 in the lower surface but only includes eighteen such recesses and the detent balls are spaced 10° apart. This results in thirty six distinct positions that result in a change of crimp height of approximately 0.004 inches.

As best seen in FIGS. 3 and 5–7, concentric ramped striking surface 43 of first adjusting plate 42*a* ranges from a "high" point 43*a* to a "low" point 43*b*. Similarly, concentric ramped striking surface 47 of second adjusting plate 46*a* ranges from a "high" point 47*a* to a "low" point 47*b*. In other words, the high points 43*a* and 47*a* of the ramped striking surfaces define the upper extreme positions of striker members 64 and 70 which, in turn, define the extreme upper positions of first and second crimping dies 18 and 20, respectively. These extreme positions define the largest or highest shut heights of the crimping dies. Similarly, low points 43*b* and 47*b* define the lowest positions of the striker members and the crimping dies and, therefore, the smallest or lowest shut heights of the crimping dies.

From the foregoing, it can be understood that the range of shut heights between height points 43*a* and 47*a* and low points 43*b* and 47*b* of first and second adjusting plates 42*a* and 46*a*, respectively, is a given parameter, but the number of adjusted shut heights of the crimping dies is limited only by the number of detent recesses 94 and 100 which are considerably larger in number than the shut height positions of the prior art. If the detent mechanisms 90–100 are eliminated, the number of adjusted shut height positions for crimping dies 18 and 20 are infinite within the range of high points 43*a*, 47*a* and low points 43*b*, 47*b* of concentric ramped striking surfaces 43 and 47, respectively.

Through such a design, adjustment of either adjusting plate 42*a* or 46*a* does not effect the positioning of the ram block 50. Rather, the adjusting plates only effect the location of the striker members 64 and 70 and crimping dies 18 and 20. Since other functions of the crimping operation such as feeding terminals are driven by the movement of the ram block, adjustment of the adjusting plates does not effect the timing of such other operations and thus makes the set-up of a new crimping operation less complicated and time consuming.

Another feature of the invention is the provision of means to prevent the transfer of any rotational forces from ramped striking surfaces 43 and 47 to striker members 64 and 70, respectively. More particularly, referring to FIGS. 3 and 4, it can be seen that upper surface 62 of striker member 64 and upper surface 68 of striker member 70 are rounded or arcuate in shape in the direction of a line which runs generally radially of axis 44. In other words, surfaces 62 and 68 present a convex surface for contacting striking surfaces 43 and 47 of circular plates 42*a* and 46*a*. Referring to FIG. 4, striker members 64 and 70 have center lines indicated at 102. It can be seen that the crest or tangent points where striking surfaces 43 and 47 engage striker surfaces 62 and 68 are on this center line 102. Therefore, when the striking surfaces strike the arcuate striker surfaces, striker members 64 and 70 will be engaged or struck on their center lines and the striker members will have no tendency to rotate as might occur if a large flat upper surface area on either striker member was present.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an electrical terminal applicator which includes an applicator ram drivable by a press ram through a working stroke towards, and a return stroke away from, a crimping anvil, a first crimping die on the applicator ram for cooperation with the anvil to crimp a first portion of an electrical terminal onto the insulation of an insulated electrical wire during each working stroke of the applicator ram;

a second crimping die on the applicator ram for cooperation with the anvil to crimp a second portion of the terminal onto a conductive core of the electrical wire during each working stroke of the applicator ram;

a first adjusting plate means mounted for rotation about an axis on and extending in the direction of movement of the applicator ram and including a concentric ramped striking surface for engaging a first striker member operatively associated with the first crimping die, to adjust the shut height of the first die in response to rotating the first adjusting plate means;

the first striker member has a generally convex upper surface and a center line generally parallel to said axis, and said first striker member being adapted to contact said striking surface of said first adjusting plate means only along a very small area adjacent said center line of said first striker member to minimize any rotational forces being transferred from the striking surface to the first striker member;

a second adjusting plate means mounted for rotation about said axis and including a concentric ramped striking surface for engaging a second striker member operatively associated with the second crimping die, to adjust the shut height of the second die independently of adjusting the shut height of the first die in response to independently rotating the second adjusting plate means; and the second striker member has a generally convex upper surface add a center line generally parallel to said axis, and said second striker member being adapted to contact said striking surface of said second adjusting plate means only along a very small area adjacent said center line of said second striker member to minimize any rotational forces being transferred from the striking surface to the second striker member.

2. In an electrical terminal applicator as set forth in claim 1, wherein the concentric ramped striking surface of the first adjusting plate means is of a larger diameter than that of the concentric ramped striking surface of the second adjusting plate means.

3. In an electrical terminal applicator as set forth in claim 1, further comprising a detent plate positioned between said first and second adjusting plates, and means operatively associated with said detent plate and said first and second adjusting plates to define a plurality of angular positions of said first and second adjusting plates.

4. In an electrical terminal applicator as set forth in claim 1, further comprising a detent plate positioned between said first and second adjusting plates, a plurality of spaced apart recesses on surfaces of said first and second adjusting plates facing said detent plate, said recesses of each adjusting plate forming a concentric, evenly spaced array, and means on said detent plate for engaging a recess of each adjusting plate to movably secure said plates in a desired predetermined position.

5. In an electrical terminal applicator which includes an applicator ram drivable by a press ram through a working stroke towards, and a return stroke away from, a crimping anvil, a first crimping die on the applicator ram for cooperation with the anvil during each working stroke of the applicator ram;

a second crimping die on the applicator ram for cooperation with the anvil during each working stroke of the applicator ram, the second crimping die being located radially inwardly of the first crimping die;

a first adjusting plate means mounted for rotation about an axis on and extending in the direction of movement of the applicator ram and including a concentric ramped striking surface for engaging a first generally convex striker surface operatively associated with the first crimping die, to adjust the shut height of the first die in response to rotating the first adjusting plate means; and a second adjusting plate means mounted for rotation about said axis and including a concentric ramped striking surface for engaging a second generally convex striker surface operatively associated with the second crimping die, to adjust the shut height of the second die independently of adjusting the shut height of the first die in response to independently rotating the second adjusting plate means, the concentric ramped striking surface of the second adjusting plate means being of a smaller diameter and located substantially within the concentric ramped striking surface of the first adjusting plate means.

6. In an electrical terminal applicator as set forth in claim 5, wherein at least one of said striker surfaces is generally on a line radially of said axis.

7. In an electrical terminal applicator as set forth in claim 6, wherein said striker surface is generally arcuate about said line.

8. In an electrical terminal applicator as set forth in claim 5, wherein at least one of said striker surfaces is defined by a striker member operatively associated with a respective crimping die, the striker member having a generally arcuate upper surface and a center line generally parallel to said axis, and said striker member being adapted to contact said striking surface of its respective adjusting plate means only along very small area adjacent said center line of said striker member to minimize any rotational forces being transferred from the striking surface to the striker member.

9. In an electrical terminal applicator as set forth in claim 5, further comprising a detent plate positioned between said first and second adjusting plates, and means operatively associated with said detent plate and said first and second adjusting plates to define a plurality of angular positions of said first and second adjusting plates.

10. In an electrical terminal applicator as set forth in claim 5, further comprising a detent plate positioned between said first and second adjusting plates, a plurality of spaced apart recesses on surfaces of said first and second adjusting plates facing said detent plate, said recesses of each adjusting plate forming a concentric, evenly spaced array, and means on said detent plate for engaging a recess of each adjusting plate to movably secure said plates in a desired predetermined position.

11. In an electrical terminal applicator which includes an applicator ram drivable by a press ram through a working stroke towards, and a return stroke away from, a crimping anvil, a first crimping die on the applicator ram for cooperation with the anvil to crimp a first portion of an electrical terminal onto the insulation of an insulated electrical wire during each working stroke of the applicator ram;

a second crimping die on the applicator ram for cooperation with the anvil to crimp a second portion of the terminal onto a conductive core of the electrical wire during each working stroke of the applicator ram;

a first adjusting plate means mounted for rotation about an axis on and extending in the direction of movement of the applicator ram and including a striking surface for engaging a striker surface operatively associated with the first crimping die, to adjust the shut height of the first die in response to rotating the first adjusting plate means; and a second adjusting plate means mounted for rotation about said axis and including a concentric ramped striking surface for engaging a striker surface on a striker member operatively associated with the second crimping die, to adjust the shut height of the second die independently of adjusting the shut height of the first die in response to independently rotating the second adjusting plate means, the striker member having a generally convex upper surface and a center line generally parallel to said axis, and said striker member being adapted to contact said striking surface of said adjusting plate means only along a very small area adjacent said center line of said striker member to minimize any rotational forces being transferred from the striking surface to the striker member.

12. In an electrical terminal applicator as set forth in claim 11, wherein the striking surface of the first adjusting plate means is of a larger diameter than that of the concentric ramped striking surface of the second adjusting plate means.

13. In an electrical terminal applicator as set forth in claim 11, wherein at least one of said striker surfaces is generally on a line radially of said axis.

14. In an electrical terminal applicator as set forth in claim 13, wherein said striker surface is generally arcuate about said line.

15. In an electrical terminal applicator as set forth in claim 11, further comprising a detent plate positioned between said first and second adjusting plates, and means operatively associated with said detent plate and said first and second adjusting plates to define a plurality of angular positions of said first and second adjusting plates.

16. In an electrical terminal applicator as set forth in claim 11, further comprising a detent plate positioned between said first and second adjusting plates, a plurality of spaced apart recesses on surfaces of said first and second adjusting plates facing said detent plate, said recesses of each adjusting plate forming a concentric, evenly spaced array, and means on said detent plate for engaging a recess of each adjusting plate to movably secure said plates in a desired predetermined position.

17. In an electrical terminal applicator as set forth in claim 16 wherein each said engaging means on said detent plate includes two spring loaded member for engaging said recesses, said spring loaded members being twice as close together as adjacent recesses whereby only one of said spring loaded members engages a recess at a time.

* * * * *